United States Patent [19]

Petro

[11] 4,229,678

[45] Oct. 21, 1980

[54] SAFETY SWITCH WHICH RENDERS HID LAMP INOPERATIVE ON ACCIDENTAL BREAKAGE OF OUTER ENVELOPE

[75] Inventor: John Petro, Belleville, N.J.

[73] Assignee: Westinghouse Electric Corp., Pittsburgh, Pa.

[21] Appl. No.: 748,351

[22] Filed: Dec. 7, 1976

[51] Int. Cl.[3] ..... H01J 7/44; H01J 13/46; H01J 19/78; H01J 23/16

[52] U.S. Cl. ..... 315/73; 315/47; 315/74; 313/17

[58] Field of Search ..... 315/73, 74, 75, 47, 315/60, 119, 125, 106, 107; 313/17, 227

[56] References Cited

U.S. PATENT DOCUMENTS

| | | | |
|---|---|---|---|
| 4,013,919 | 3/1977 | Corbley | 315/107 |
| 4,013,920 | 3/1977 | Petro | 315/107 |
| 4,032,816 | 6/1977 | Rokosz | 315/73 |
| 4,143,301 | 3/1979 | Strauss et al. | 315/73 |
| 4,156,830 | 5/1959 | Strauss et al. | 315/74 |

*Primary Examiner*—Saxfield Chatmon, Jr.
*Attorney, Agent, or Firm*—R. S. Lombard

[57] ABSTRACT

An HID lamp has a very positive acting and simple resilient safety switch positioned proximate the inner surface of the bulb portion of the protective outer envelope and in contact therewith which maintains the switch in a closed position. When the envelope is shattered, the closed switch will open to break the electrical path to the arc tube, thereby rendering the lamp inoperative.

3 Claims, 5 Drawing Figures

SAFETY SWITCH WHICH RENDERS HID LAMP INOPERATIVE ON ACCIDENTAL BREAKAGE OF OUTER ENVELOPE

CROSS-REFERENCE TO RELATED APPLICATIONS

In copending application Ser. No. 607,411, filed Aug. 25, 1975 by R. H. Atkinson, and owned by the present assignee, is disclosed an HID lamp which has an oxidizable link positioned between the outer protective envelope and the arc tube and electrically connected in series with one of the lamp electrodes. Under normal lamp operating conditions, the link is heated to an incandescent condition. When the outer envelope is accidently broken, the link immediately oxidizes and breaks to open the arc tube energizing circuit and render the lamp inoperative.

In copending application Ser. No. 649,775, filed Jan. 16, 1976 by F. Rokosz, which in turn is a continuation-in-part of copending application Ser. No. 609,138, filed Aug. 29, 1975, and owned by the present assignee, is disclosed an HID lamp which has a spring-loaded safety switch positioned between the outer protective envelope and the arc tube and electrically connected in series with one of the lamp electrodes. When the lamp is operating normally, the safety switch is maintained in the closed position, but if the outer envelope is accidentally broken, the switch automatically opens to break the lamp energizing circuit and render the lamp inoperative.

In copending application Ser. No. 651,306, filed on Jan. 22, 1976, by J. Petro, the present applicant, and owned by the present assignee, is disclosed an HID lamp which has a resilient safety switch positioned proximate the inner surface of the dome portion of the protective outer envelope in contact with an extremity of a resilient leaf-spring support portion of the arc tube frame, to maintain the switch in a closed position and which functions in the same manner as the switch of the aforesaid Rokosz application. The switch arrangement disclosed in the present application constitutes an improvement over those disclosed in the aforementioned copending applications, in that, it is positive acting, is readily adaptable to automatic manufacturing processes, and is simple and inexpensive.

BACKGROUND OF THE INVENTION

It has been reported that high-intensity discharge (HID) lamps, such as high-pressure, mercury-vapor lamps, can constitute a safety hazard if the outer envelope is broken and the lamp continues to operate, because of the generation of short wavelength ultraviolet radiations which are passed by the quartz arc tube. Lamps which are protected by a fuse are generally known in the art and a projection lamp which is fused in order to prevent dangerous arcing currents is described in U.S. Pat. No. 2,859,381 dated Nov. 4, 1958.

High-intensity discharge lamps have also been provided with an incandescent filament included between the arc tube and the outer envelope for purposes of ballasting the discharge and also generating some visible light. While the purpose of the ballasting and light-generating filament is not that of a link or safety switch, such a filament will normally oxidize and fail, particularly under lamp start-up conditions, if the outer envelope is broken, since this permits the filament to come in contact with air. Of course, such a supplemental ballasting filament consumes an appreciable portion of the total power consumed by the lamp, which decreases the lamp operating efficiency.

SUMMARY OF THE INVENTION

The basic HID lamp comprises an elongated radiation-transmitting arc tube having pressed-end portions which is longitudinally disposed and supported within an elongated light-transmitting protective envelope. The envelope has a neck portion, a bulb portion having an inner surface and an outer surface, and a dome portion. The envelope is opaque to short wavelength ultraviolet radiations. The arc tube encloses a discharge-sustaining filling and electrodes are operatively positioned therein proximate the ends thereof. Electrical lead-in members are sealed through the arc tube and connected to the electrodes. An electrical adaptor means, such as a screw-type base, is affixed to the neck portion of the envelope to facilitate electrical connection of the lamp to a source of electrical power and electrical conductor means electrically connect the base to the arc tube lead-in members. The electrical conductor means includes a conventional arc tube supporting frame comprising an elongated rigid supporting means longitudinally disposed within the protective envelope. The arc tube supporting frame also includes rigid metallic members generally transversely disposed within the protective envelope and in supportive relationship with respect to the pressed-end portions of the arc tube. The foregoing lamp construction is generally conventional.

In accordance with the present invention, there is provided a switch means having an open position in which it is electrically non-conducting and a closed position in which it is electrically conducting. The switch means is included in series circuit arrangement intermediate the arc tube supporting frame and one of the arc tube electrical lead-in members. The switch means has an electrically conductive contact member affixed to the lead-in member which is positioned nearest the dome portion of the protective envelope. The switch means also has a resilient elongated conductive contact having a leaf-spring configuration which has one end affixed to one of the rigid metallic membes of the frame which is positioned nearest the dome portion of the protective envelope. The resilient contact initially extends toward the dome portion and then toward the inner surface of the bulb portion and is then retroverted toward the opposite inner surface of the bulb portion to contact same and thereby be forced against its resiliency into electrical contact with the rigid conductive member to close the switch. Breakage of the protective envelope permits the resilient elongated conductive contact to be moved by its resiliency out of electrical contact with the electrically conductive contact member, thereby opening the electrical circuit and rendering the lamp inoperative.

BRIEF DESCRIPTION OF THE DRAWINGS

For a better understanding of the invention, reference may be had to the preferred embodiment, exemplary of the invention, shown in the accompanying drawings, in which.

DESCRIPTION OF THE PREFERRED EMBODIMENT

Figure 1:
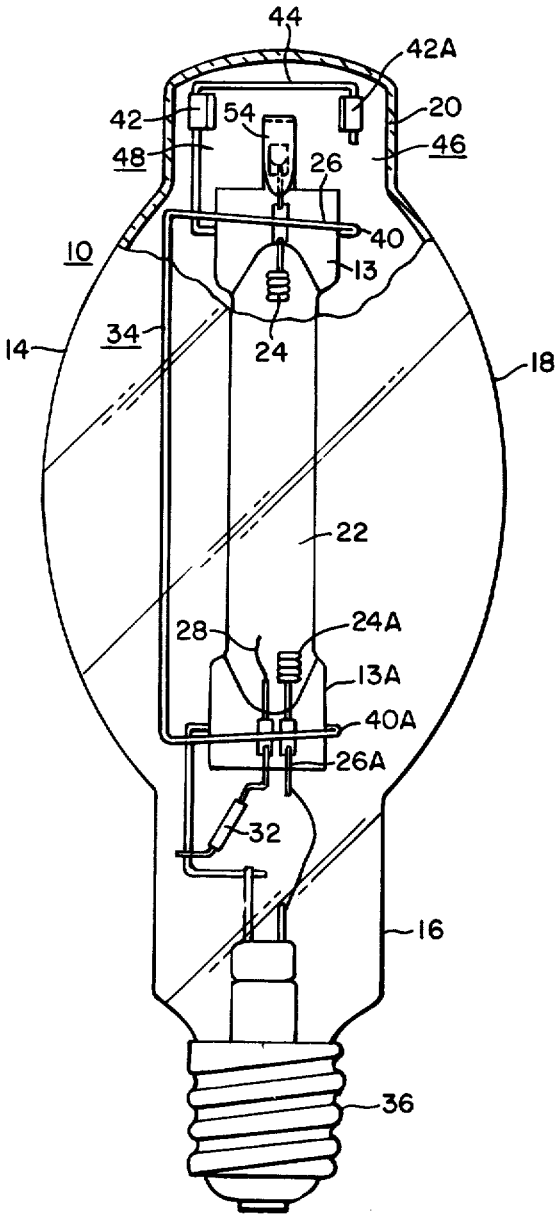
FIG. 1 is an elevational view, partly broken away, showing a high-intensity discharge lamp with the unitary arc tube supporting frame positioned on one side of the arc tube and which incorporates a built-in safety switch, in accordance with the present invention.

In FIG. 1 is shown a high-intensity discharge lamp which in this embodiment is a high-pressure, mercury-vapor discharge lamp 10. The lamp comprises an elongated radiation-transmitting quartz arc tube 12 having pressed-end portions 13, 13A which is longitudinally disposed and supported within an elongated light-transmitting protective envelope 14 having a neck portion 16, a bulb portion 18 having an inner surface and an outer surface, and a dome portion 20. The envelope 14 is formed of glass, such as borosilicate glass, which is transmissive for visible radiations and opaque with respect to the short wavelength ultraviolet radiations which are generated within and transmitted through the arc tube 12. In accordance with conventional practices, the arc tube encloses a discharge-sustaining filling such as a small charge of mercury 22 and a small charge of inert starting gas such as 4 torrs of argon. The arc tube has electrodes 24, 24A operatively positioned therein proximate the ends thereof and electrical lead-in members 26, 26A are sealed through the arc tube and connected to the electrodes. A starting electrode 28 is positioned at one end of the arc tube and sealed through the pressed-end portion 13A, and the starting electrode 28 connects through a starting resistor 32 to the arc tube supporting frame 34.

Electrical adaptor means 36, such as a conventional screw-type base, is affixed to the neck portion 16 of the outer envelope 14 in order to facilitate electrical connection of the lamp 10 to a source of electrical power and an electrical conductor means electrically connects the base 36 to the lead-in members 26, 26A. The electrical conductor means includes the arc tube supporting frame 34 which comprises an elongated rigid supporting means 38 longitudinally disposed within the protective envelope 14 and including rigid metallic members 40, 40A which are disposed generally transversely within the protective envelope. The rigid metallic members 40, 40A are in supportive relationship with respect to the pressed-end portions 13, 13A of the arc tube 12. The single supporting means 38 in FIG. 1 is positioned on only one side of the arc tube 12. Flexible leaf-spring metallic members 42, 42A are fixed proximate the extremity portion 44 of the rigid supporting means 38 within the dome portion 20 of the protective envelope 14. The lamp and arc tube support as described hereinbefore are generally conventional.

In accordance with the present invention, and referring to FIGS. 1–4, there is provided a switch means 46 having an open position in which it is electrically non-conducting and a closed position in which it is electrically conducting. The switch means 46 is included in series circuit arrangement intermediate the arc tube supporting frame 34 and one of the electrical lead-in members 26. The switch 46 has an electrically conductive contact member 48 affixed to the one lead-in member 26 which is positioned nearest the dome portion 20 of the protective envelope 14. The electrically conductive contact member 48 comprises an elongated metallic member 50 which initially extends toward the dome portion 20 and then toward the inner surface of the bulb portion 18. The metallic member 50 is preferably resilient and fabricated of heat resistant metal, such as nickel alloy. The switch 46 also includes a resilient elongated conductive contact 54 having one end affixed to one of the rigid metallic members 40 of the frame 30 which is positioned nearest the dome portion 20. The resilient contact 54 has a leaf-spring configuration initially extending toward the dome portion 20 and then toward the inner surface of the bulb portion 18 and is then retroverted toward the opposite inner surface of the bulb portion 18 to contact the same and be forced against its resiliency into electrical contact with the electrically conductive member 48. The resilient contact 54 is also preferably fabricated of heat resistant metal, such as nickel alloy. Breakage of the protective envelope 14 frees the resilient elongated conductive contact 54, permitting it to be moved by its resiliency out of electrical contact with the electrically conductive member 48, thereby rendering the lamp inoperative.

The switch means 46 is designed so that the elongated metallic member 50 and the resilient retroverted conductive contact 54 both ultimately extend generally colinearly. The contact of the resilient retroverted conductive contact 54 with the inner surface of the bulb portion 18 forces both the elongated metallic member 50 and the resilient retroverted contact 54 into electrical contact against their resiliencies.

Figure 5:
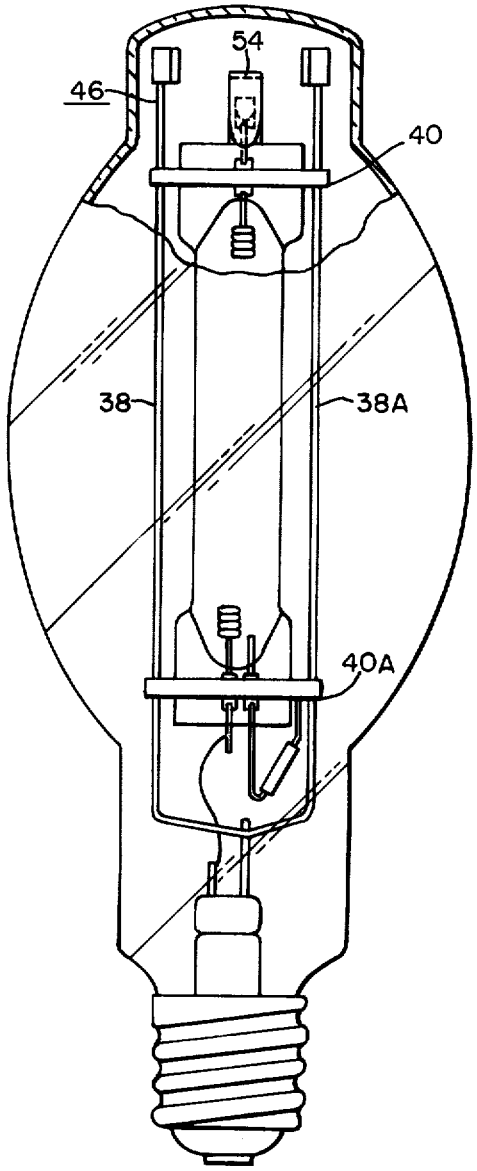
FIG. 5 is an elevational view, showing a high-intensity discharge lamp with a two-member arc tube supporting frame extending on opposite sides of the arc tube and which incorporates a built-in safety switch, in accordance with the present invention.
Figure 2:
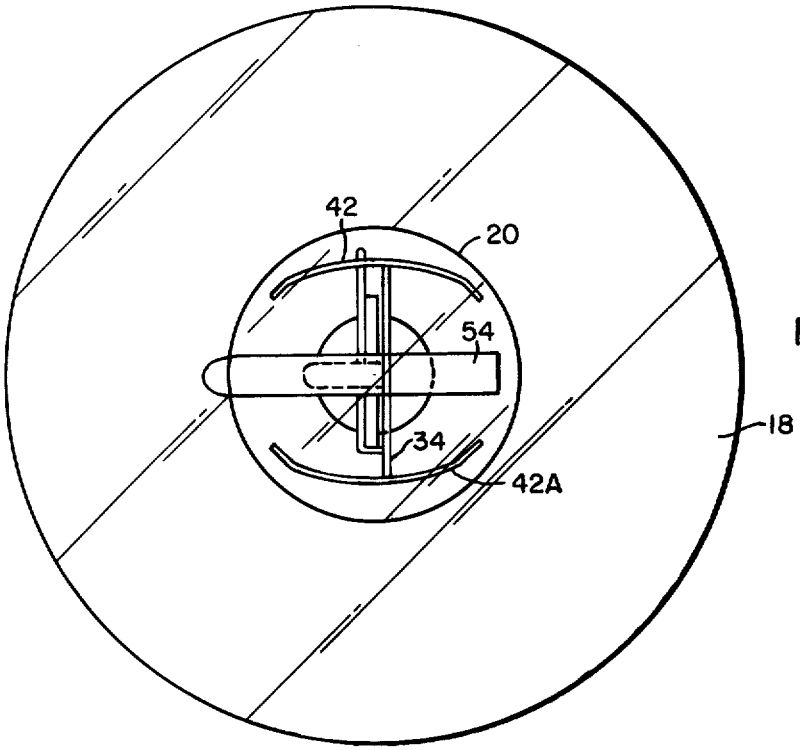
FIG. 2 is an enlarged plan view, showing the position of the safety switch within the lamp.
Figure 4:
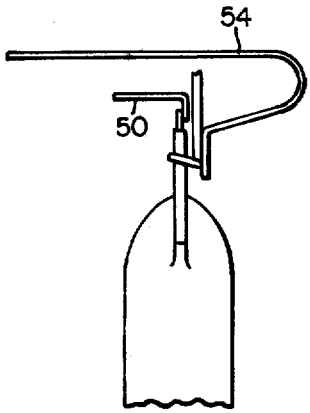
FIG. 4 is an enlarged fragmentary elevational view showing the safety switch in the open position resulting from breakage of the lamp envelope.
Figure 3:
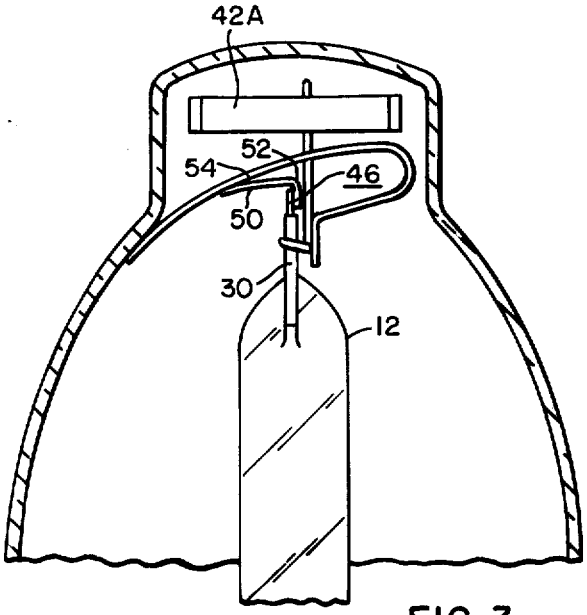
FIG. 3 is an enlarged fragmentary elevational view, shown partly in section, showing the safety switch in its closed position within the protective envelope.

FIG. 5 shows a high-intensity discharge lamp which incorporates a variation in the construction of the supporting frame 30, wherein two supporting means 38, 38A extend on opposite sides of the arc tube. The switch means 46 is identical to that illustrated in FIGS. 1–4 and described hereinbefore.

The switch configuration as shown has been found to be more reliable than other configurations as far as its adaptability to automatic mounting machines used in large scale production. The switch is very positive acting and yet is very simple in its construction.

I claim as my invention:

1. In combination with a high-intensity discharge lamp comprising an elongated radiation-transmitting arc tube having pressed-end portions which is longitudinally disposed and supported within an elongated light-transmitting protective envelope having a neck portion, a bulb portion having an inner surface and an outer surface, and a dome portion and which envelope is opaque to short wavelength ultraviolet radiations, said arc tube enclosing a discharge-sustaining filling and having electrodes operatively positioned therein proximate the ends thereof, electrical lead-in members sealed through said arc tube and connected to said electrodes, electrical adaptor means affixed to the neck portion of said envelope to facilitate electrical connection of said lamp to a source of electrical power, electrical conductor means electrically connecting said electrical adaptor means to said electrical lead-in members, said electrical conductor means including an arc tube supporting frame comprising an elongated rigid supporting means longitudinally disposed within said protective envelope and including ridig metallic members disposed generally transversely within said protective envelope and in supportive relationship with respect to the pressed-end portions of said arc tube, the improvement which comprises:

switch means having a normally open position in which said switch means is electrically non-conducting and a closed position in which said switch means is electrically conducting, said switch means included in series circuit arrangement intermediate said arc tube supporting frame and one of said lead-in members, said switch means including an electrical conductive contact member affixed to said one lead-in member which is positioned nearest said dome portion of said protective envelope, said electrical conductive contact member comprising an elongated resilient metallic member initially extending toward said dome portion and then toward the inner surface of said bulb portion, a resilient elongated conductive contact having one end affixed to one of said rigid metallic members of said frame which is positioned nearest said dome portion, said resilient contact initially extending toward said dome portion and then toward the inner surface of said bulb portion and then retroverted toward the opposite inner surface of said bulb portion to contact the opposite inner surface of said bulb portion, said elongated metallic member and said resilient retroverted conductive contact both ultimately extend generally collinearly, and the contact of said resilient retroverted conductive contact with the inner surface of said bulb portion forces both said elongated metallic member and said resilient retroverted conductive contact into electrical contact against their resiliencies, and breakage of said protective envelope freeing said retroverted contact and permitting said retroverted contact to be moved by its resiliency out of electrical contact with said electrical conductive contact member, thereby to render said lamp inoperative.

2. The lamp as specified in claim 1, wherein said supporting means longitudinally disposed within said protective envelope is positioned on one side of the arc tube.

3. The lamp as specified in claim 2, wherein said supporting means longitudinally disposed within said protective envelope is positioned on opposite sides of said arc tube.

* * * * *